United States Patent [19]

Pringle

[11] Patent Number: 4,495,998

[45] Date of Patent: Jan. 29, 1985

[54] TUBING PRESSURE BALANCED WELL SAFETY VALVE

[75] Inventor: Ronald E. Pringle, Houston, Tex.

[73] Assignee: Camco, Incorporated, Houston, Tex.

[21] Appl. No.: 588,609

[22] Filed: Mar. 12, 1984

[51] Int. Cl.[3] ..... E21B 34/10

[52] U.S. Cl. ..... 166/321; 166/374

[58] Field of Search ..... 166/321, 319, 320, 324, 166/374, 375, 383, 386, 332-334; 277/29, 59, 71, 72 R, 72 FM

[56] References Cited

U.S. PATENT DOCUMENTS

| | | | |
|---|---|---|---|
| 3,897,825 | 8/1975 | Tausch | 166/321 X |
| 4,086,935 | 5/1978 | Raulins et al. | 166/321 X |
| 4,161,219 | 7/1979 | Pringle | 166/324 |

*Primary Examiner*—Stephen J. Novosad
*Assistant Examiner*—Thuy M. Bui
*Attorney, Agent, or Firm*—Fulbright & Jaworski

[57] ABSTRACT

A well safety valve for controlling the fluid flow through a well conduit having a tubular housing and valve closure member moving between open and closed positions by a longitudinally tubular member telescopically movable in the housing. A piston and cylinder assembly is positioned in the housing, connected to the tubular member, and actuated by hydraulic fluid from the well surface for moving the valve to an open position. The valve prevents pressure in the well conduit from affecting the opening or closing of the valve by providing first and second spaced seal means between the tubular member and the housing for preventing fluid pressure in the tubular member from communicating with the piston and cylinder assembly. The outside diameter of the tubular member on which the first and second seals engage are of the same diameter whereby the tubular member is pressure balanced. The second side of the piston and cylinder assembly is vented through the housing whereby hydrostatic pressure in the well acts to close the valve. The first and second seals each include two circular seals and a vent passageway leading from between the two circular seals to the exterior of the housing for further isolating the piston and cylinder assembly from the well pressure.

8 Claims, 5 Drawing Figures

11a
31a
12'a
12a
10a
14a
35
32a
52a
56a
48a
54a
64a
34a
44a
22a
42a
30a
26a 26a
28a
22a
14a
58a
50a
60a
62a
16a
20a
24a
18a

TUBING PRESSURE BALANCED WELL SAFETY VALVE

BACKGROUND OF THE INVENTION

Generally, it is well known to provide a subsurface well safety valve for use in a well for shutting off flow of well fluids through the well tubing. U.S. Pat. No. 4,161,219 issued July 17, 1979, discloses a piston actuated safety valve which is biased to an open position and is closed in response to hydraulic fluid applied from the well surface. In that valve the fluid pressure in the well conduit acts against the piston and cylinder assembly in a direction to move the valve to a closed position. However, in that case the pressure in the well conduit or tubing is working against the hydraulic control fluid from the surface which requires increased hydraulic control pressure acting against a tubing or conduit pressure which is undesirable, as well as variable, in some applications.

The present invention is directed to an improved piston and cylinder actuated subsurface safety valve in which the well pressure in the well conduit or tubing does not affect the opening or closing of the safety valve and thus provides a so-called balanced valve insofar as the effect of well tubing pressure is concerned.

SUMMARY

The present invention is directed to a subsurface well safety valve in which the valve is constructed and sealed so that the effects of the pressure in the well conduit or bore of the safety valve does not affect the opening or closing of the safety valve. The valve structure and seals are sized so as to be balanced in both a closing direction and an opening direction so far as the effects of tubing pressure is concerned.

Yet a further object of the present invention is the provision of a well safety valve for controlling the fluid flow through a well conduit which includes a tubular housing and a valve closure member moving between open and closed positions. A longitudinal tubular member is telescopically movable in the housing for controlling the movement of the valve closure member. Biasing means are provided acting on the tubular member in a first direction for causing the valve closure member to move to the closed position. A piston and cylinder assembly is positioned in the housing, one of which is connected to the tubular member, and one side of the assembly is adapted to be in communication with hydraulic fluid extending to the well surface for moving the valve closure member to the open position. The present improvements preclude pressure in the well conduit from affecting the opening and closing of the valve by providing first and second space seal means between the tubular member and the housing for preventing well pressure in the tubular member from communicating with the piston and cylinder assembly. In addition, the outside diameter of the tubular member on which the first and second seal means act are of the same diameter whereby the forces acting on the tubular member from the well pressure in the tubular member is balanced. In addition, the second side of the piston and cylinder assembly is vented for allowing operation of the assembly by the hydraulic control fluid from the surface acting on the one side of the assembly.

Still a further object of the present invention is wherein the vent extends through the housing to the outside of the housing whereby hydrostatic pressure in the well outside of the valve acts on the piston and cylinder assembly in a direction to close the valve and to compensate for the hydrostatic pressure in the control line leading to the surface.

Still a further object of the present invention is wherein the first and second seal means each includes two circular seals with a vent passage leading from between the seals for further isolating the piston and cylinder assembly from pressure within the tubular member. Preferably the vents lead to the exterior of the valve housing.

Yet a still further object of the present invention is wherein a hydraulic chamber is formed between the housing and the tubular member and is adapted to be connected to the well surface for receiving hydraulic control fluid and transmit the control fluid to one side of the hydraulic piston and cylinder assembly. First and second space seal means are at opposite ends of the chamber for preventing fluid pressure in the tubular member from communicating with the hydraulic chamber and the one side of the piston and cylinder assembly.

Still a further object of the present invention is the provision of another embodiment in which a hydraulic vent chamber is formed between the housing and the tubular member and includes an opening extending through the housing in which the vent chamber is in communication with the second side of the piston and cylinder assembly. In this embodiment the first and second spaced seal means are on opposite sides of the vent chamber for preventing fluid pressure in the tubular member from communicating with the second side of the piston and cylinder assembly.

Other and further objects, features and advantages will be apparent from the following description of presently preferred embodiments of the invention, given for the purpose of disclosure and taken in conjunction with the accompanying drawings.

DESCRIPTION OF THE PREFERRED EMBODIMENT

While the present improvement in a subsurface well safety valve will be shown, for purposes of illustration only, as incorporated in a flapper-type tubing retrievable safety valve, it will be understood that the present invention may be used with other types of safety valves and safety valves having various types of valve closing elements.

Figure 1A:
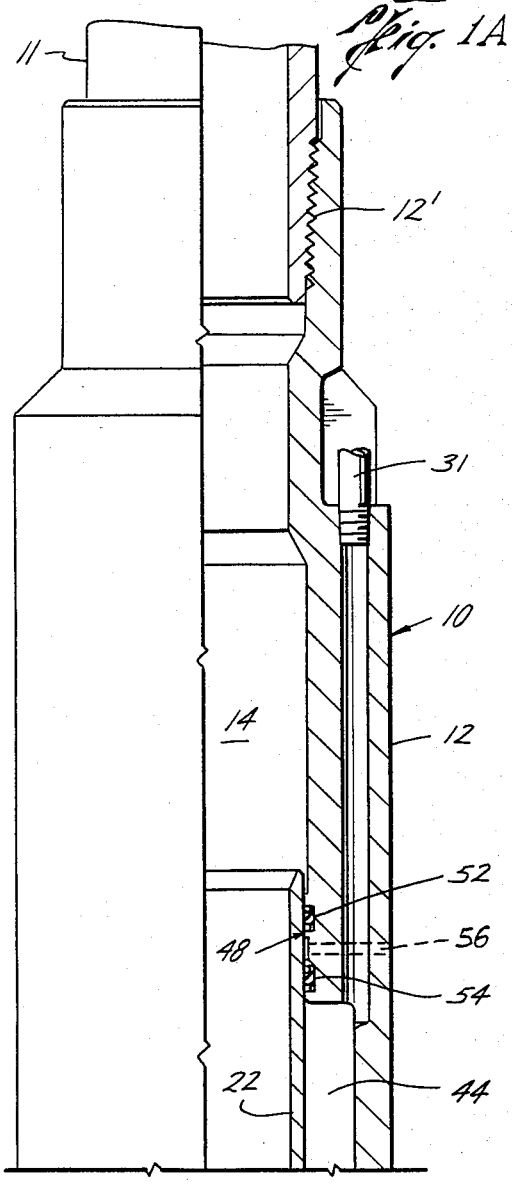
FIGS. 1A and 1B are continuations of each other of a fragmentary elevational view, partly in cross section, of a well safety valve utilizing one form of the present invention and shown in the open position.
Figure 1B:
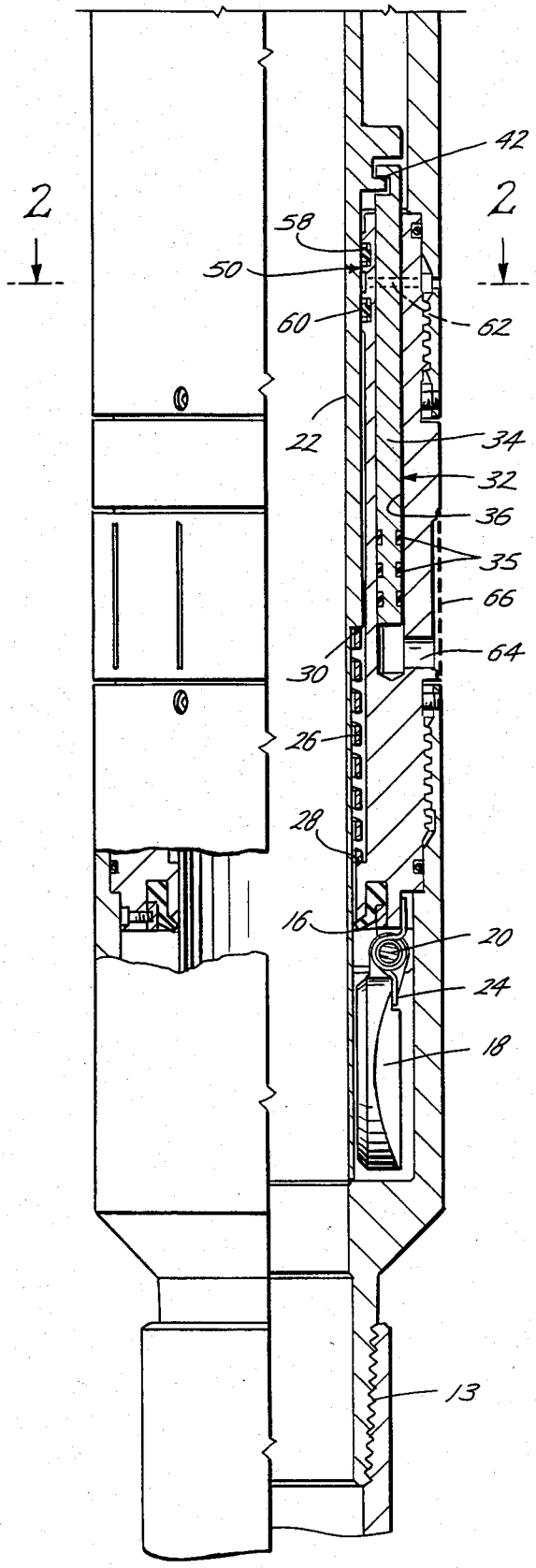

Referring now to the drawings, and in particular to FIGS. 1A and 1B, the subsurface safety valve of the present invention is generally indicated by the reference numeral 10 and is shown as being of a non-retrievable type for connection in a well conduit or well tubing 11 such as by a threaded box 12' at one end and a threaded pin 13 at the other end for connecting the safety valve 10 directly into the tubing 11 of an oil and/or gas well.

The safety valve 10 generally includes a body or housing 12 adapted to be connected in a well tubing to form a part thereof and to permit well production therethrough under normal operating conditions, but in which the safety valve 10 may close or be closed in response to abnormal conditions such as might occur when the well overproduces, blows wild, or in event of failure of well equipment.

The safety valve 10 generally includes a bore 14, an annular valve seat 16 positioned about the bore 14, a valve closure element such as a flapper valve 18 connected to the body 12 by a pivot pin 20. Thus, when the flapper 18 is in the upper position and seated on the valve seat 16, the safety valve 10 is closed blocking flow upwardly through the bore 14 and the well tubing 11. A sliding tube or tubular member 22 is telescopically movable in the body 12 and through the valve seat 16.

As best seen in FIG. 1B, when the tubular member 22 is moved to a downward position, the tube 22 pushes the flapper 18 away from the valve seat 16. Thus, the valve 10 is held in the open position so long as the sliding tube 22 is in the downward position. When the sliding tube 22 is moved upwardly, the flapper 18 is allowed to move upwardly onto the seat 16 by the action of a spring 24 and also by the action of fluid flow moving upwardly through the bore 14 of the body 12.

Various forces may be provided to act on the tubular member 22 to control its movement so that under operating conditions the tubular member 22 will be in the downward position holding the flapper 18 away from and off of the valve seat 16 so that the valve 10 will be open. When abnormal conditions occur, the tubular member 22 will be moved upwardly allowing the flapper 18 to close shutting off flow to the valve 10 and well tubing 11. Thus, biasing means, such as a spring 26 or a pressurized chamber (not shown), may act between a shoulder 28 on the valve body 12 and a shoulder 30 on the tubular member 22 for yieldably urging the tubular member 22 in an upward direction to release the flapper 18 for closing the valve 10.

The safety valve 10 is controlled by the application or removal of a pressurized fluid, such as hydraulic fluid, through a control path or line, such as control line 31, extending to the well surface which supplies a pressurized hydraulic fluid to the top of a piston and cylinder assembly generally indicated by the reference numeral 32, one of which, such as the piston 34, which moves in a cylinder 36, is connected to the tubular member 22. When the hydraulic fluid is applied to the assembly 32, one of the members, such as the piston 34, moves the tubular member 22 downwardly forcing the flapper 18 off of the seat 16 and into the full open position. If the fluid pressure in the conduit 31 is reduced sufficiently relative to the forces urging the tubular member 22 upwardly, the tubular member 22 will move upwardly beyond the seat 16 allowing the flapper 18 to swing and close on the seat 16.

The above description is generally disclosed in U.S. Pat. No. 4,161,219. However, in that patent the fluid pressure in the bore 14 acts against the piston to move the piston to a closed position. The pressure in the bore 14 is variable and if it acts against the bottom of the piston and cylinder assembly 32, then this force must be overcome by the force applied to the control line 31. That is, the well pressure in the bore 14 is working against the control pressure in line 31. Therefore, in some applications, it is desirable to use a balanced valve, that is a valve which is balanced with respect to the well pressure in the bore 14 acting against the valve so that the well or tubing pressure does not affect either the opening or closing operation of the valve 10.

Referring to FIGS. 1A and 1B, one of the piston and cylinder assembly 32, such as the piston 34, is connected to the tubular member 22 by a suitable connection such as a tongue and groove connection 42 and the piston 34 is exposed to fluid pressure in a chamber 44 which is in communication with the control line 32. In order to prevent pressure in the bore 14 from affecting the opening and closing of the valve 10, first seal means generally indicated by the reference numeral 48 and second seal means generally indicated by the reference numeral 50 are provided between the external diameter of the tubular member 22 and the housing 12 for preventing fluid pressure in the bore 14 from communicating with the chamber 44 and with the piston and cylinder assembly 32. The fluid pressure in the bore 14 will act against both ends of the tubular member 22 across the cross section of the tubular member 22 which engages the seal means 48 and 50. Therefore, it is important that the outside diameter of the tubular member 22 which engages the first seal means 48 and the second seal means 50 be the same so that the forces acting on the tubular member from pressure in the bore 14 is balanced.

However, if either of the seal means 48 or 50 fails, the well pressure in the bore 14 will flow into the chamber 44, and act against the piston 34 in a direction to cause the valve 10 to open. If the well pressure is sufficient to overcome the biasing spring 26, the valve 10 will fail in the open position. In order to reduce this possibility, each of the first 48 and second 50 seals means includes two circular seals and a vent passageway leading from between the two circular seals to outside of the housing 12 for further isolating the piston and cylinder assembly 32 from the pressure within the bore 14 of the tubular member 22. Thus, seal means 48 includes first and second circular seals 52 and 54 with a vent passageway 56 therebetween extending to outside of the housing 12. Similarly, seal means 50 includes first and second circular seals 58 and 60 with a vent passageway 62 therebetween leading to the exterior of the housing 12. Thus, assuming that the seal 52 fails, the tubing pressure in the bore 14 will be diverted through the passageway 56 thereby enabling the seal 54 to maintain the seal between the tubular member 22 and the housing 12. Similarly, if the seal 60 fails, the tubing pressure will flow out the vent passageway 62 allowing the seal 58 to maintain the bottom seal between the tubular member 22 and the housing 12. Therefore, the seal means 48 and 50 are adapted to maintain a tubing pressure balance on the tubular member 22 and isolate the piston and cylinder assembly 32 from the tubing pressure in the bore 14.

In order to allow the piston and cylinder assembly 32 to be actuated to an open position and to a closed position, the second side of the piston and cylinder assembly 32 is vented through a vent passageway 64 in the housing 12. The vent 64 is connected to the exterior of the housing and thus is in communication with the annulus around the safety valve 10 in a well bore whereby any hydrostatic pressure of fluid standing in the annulus acts on the second side of the piston 34 to hydrostatically bias the piston 34 to a closed position for assisting the biasing force of the spring 26. A screen 66 is provided on the exterior of the housing 12 over the vent passageway 64 for reducing the entry of contaminants into the cylinder 36. If desired, the vent passageway 64, instead of being connected to the annulus, may be connected to a second hydraulic control line (not shown) extending to the well surface for hydrostatically biasing the piston 34.

Figure 2:
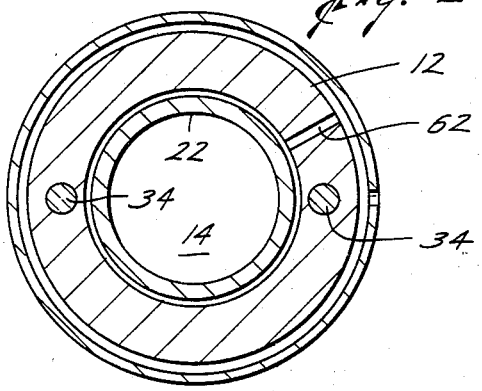
FIG. 2 is a cross-sectional view taken along the line 2—2 of FIG. 1B, and FIGS. 3A and 3B are continuations of each other of a fragmentary elevational view, partly in cross section, of another embodiment of a safety valve utilizing the present invention and shown in the open position.
Figure 3A:
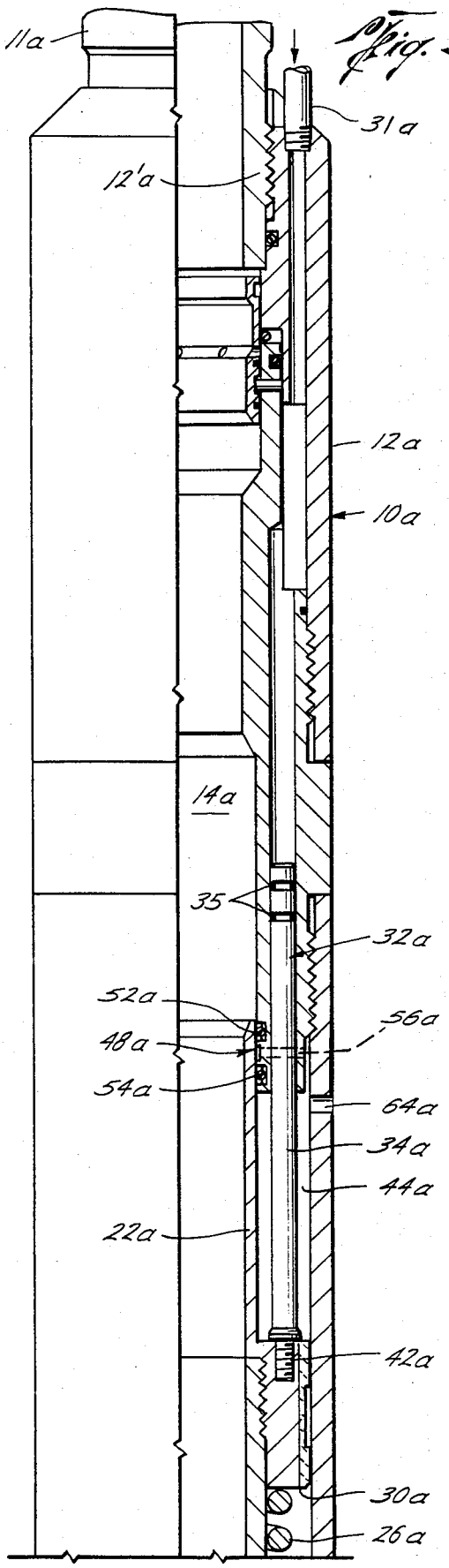
Figure 3B:
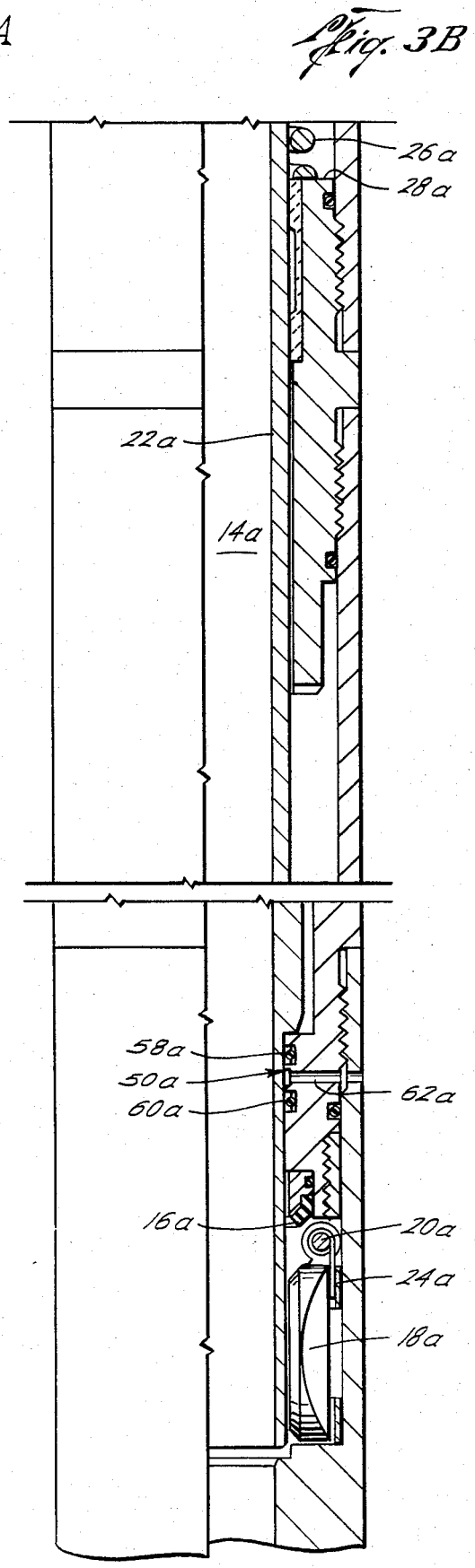

Other and further embodiments of the present invention may be provided such as shown in FIGS. 3A and 3B wherein like parts to those shown in FIGS. 1 and 2 are similarly numbered with the addition of the suffix "a". Referring to FIGS. 3A and 3B, the chamber 44*a* between the housing 12*a* and the tubular member 22*a* is in communication with the second side of the piston and cylinder assembly 32*a* instead of the first side as shown in FIGS. 1 and 2. In addition, the chamber 44*a* is a vent chamber which includes a vent passageway 64*a* from the second side of the piston and cylinder assembly 32*a* to exteriorly of the housing 12*a*. Again, the first and second seal means 48*a* and 50*a* are positioned on opposite ends of the chamber 44*a* and between the tubular member 22*a* and the housing 12*a* for preventing pressure in the tubular member 22 and in the bore 14*a* from communicating with the piston and cylinder assembly 32*a*. Similarly, the outside diameter of the tubular member 22*a* on which the first seal means 48*a* and the second means 50*a* engage, are of the same diameter whereby the forces on the tubular member 22 from the pressure in the bore 14 is balanced. Again, the first seal means 48*a* and the second seal means 50*a* includes two circular seals being seals 52*a* and 54*a*, and 58*a* and 60*a*, respectively, with vent passageways 56*a* and 62*a* leading from between their respective circular seals for further isolating the piston and cylinder assembly 32*a* from the pressure within the bore 14*a*.

The present invention, therefore, is well adapted to carry out the objects and attain the ends and advantages mentioned as well as others inherent therein. While presently preferred embodiments of the invention have been given for the purpose of disclosure, numerous changes in the details of construction and arrangement of parts will be readily apparent to those skilled in the art and which are encompassed within the spirit of the invention and the scope of the appended claims.

What is claimed is:

1. In a well safety valve for controlling the fluid flow through a well conduit and including a tubular housing and a valve closure member moving between open and closed positions, a longitudinally tubular member telescopically movable in the housing for controlling the movement of the valve closure member, means for biasing the tubular member in a first direction for causing the valve closure member to move to the closed position, a piston and cylinder assembly positioned in the housing, one of which is connected to the tubular member, one side of the assembly adapted to be in communication with hydraulic fluid extending to the well surface for moving the valve closure member to the open position, the improvement in means for preventing pressure in the well conduit from affecting the opening and closing of the valve comprising, first and second spaced seal means between the tubular member and the housing for preventing fluid pressure in the tubular member from communicating with the piston and cylinder assembly, the outside diameter of the said tubular member on which the first and second seal means engage being of the same diameter whereby the forces on the tubular member from the pressure in the tubular member is balanced, and a vent port in communication with the second side of the piston and cylinder assembly for allowing operation of the assembly by hydraulic fluid from the surface acting on said one side of the assembly.

2. The apparatus of claim 1 wherein the vent extends through the housing whereby hydrostatic pressure in a well acts on the assembly in a direction to close the valve.

3. The apparatus of claim 1 wherein each of the first and second seal means include two circular seals and a vent passageway leading from between said two circular seals for further isolating the piston and cylinder assembly from the pressure within the tubular member.

4. The apparatus of claim 2 wherein each of the first and second seal means include two circular seals and a vent passageway leading from between said two circular seals for further isolating the piston and cylinder assembly from the pressure within the tubular member.

5. A well safety valve for controlling the fluid flow through a well conduit comprising, a housing having an open bore and adapted to be positioned in the well tubing, a valve closure member in the housing bore and movable between open and closed positions for opening and closing fluid flow through the bore and said tubing, a longitudinally tubular member telescopically movable in the housing for controlling the movement of the valve closure member, means for biasing the tubular member in a first direction for allowing the valve closure member to move to the closed position, a piston and cylinder assembly positioned in the housing, and one of which is connected to the tubular member, a hydraulic chamber formed between the housing and the tubular member and adapted to be connected to the well surface for receiving hydraulic control fluid, one side of said assembly being in communication with the hydraulic chamber for actuating the tubular member in a second direction for opening the valve closure member, first and second spaced seal means on opposite ends of the chamber and between the tubular member and housing for preventing fluid pressure in the tubular member from communicating with the piston and cylinder assembly, the outside diameter of said tubular member on which the first and second seal means engage being of the same diameter whereby the forces on the tubular member from the pressure in the tubular member is balanced, and a vent port extending between the outside of the housing and the second side of the piston and cylinder assembly for allowing operation of the assembly by hydraulic fluid in the chamber acting on said one side of the assembly.

6. The apparatus of claim 5 wherein each of the first and second seal means include two circular seals and a vent passageway leading from between said two circular seals for further isolating the piston and cylinder assembly from the pressure within the tubular member.

7. A well safety valve for controlling the fluid flow through a well conduit comprising, a housing having an open bore and adapted to be positioned in the well tubing, a valve closure member in the housing bore and movable between open and closed positioned for opening and closing fluid flow through the bore and said tubing, a longitudinally tubular member telescopically movable in the housing for controlling the movement of the valve closure member, means for biasing the tubular member in a first direction for allowing the valve closure member to move to the closed position, a piston and cylinder assembly positioned in the housing, and one of which is connected to the tubular member, one side of the assembly adapted to be in communication with hydraulic fluid extending to the well surface for moving the valve closure member to the open position, a hydraulic vent chamber formed between the housing and the tubular member and including an opening extending through the housing, said vent chamber being in communication with the second side of the piston and cylinder assembly, first and second spaced seal means on opposite ends of the chamber and between the tubular member and the housing for preventing fluid pressure in the tubular member from communicating with the piston and cylinder assembly, and the outside diameter of said tubular member on which the first and second seal means engage being of the same diameter whereby the forces on the tubular member from the pressure in the tubular member is balanced.

8. The apparatus of claim 7 wherein each of the first and second seal means include two circular seals and a vent passageway leading from between said two circular seals for further isolating the piston and cylinder assembly from the pressure within the tubular member.

* * * * *